US007032643B2

(12) United States Patent
Bhangu et al.

(10) Patent No.: US 7,032,643 B2
(45) Date of Patent: Apr. 25, 2006

(54) INVESTMENT MOULDING PROCESS AND APPARATUS

(75) Inventors: Jagnandan K Bhangu, Derby (GB); John W Harrison, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 11/048,771

(22) Filed: Feb. 3, 2005

(65) Prior Publication Data

US 2005/0126735 A1 Jun. 16, 2005

Related U.S. Application Data

(62) Division of application No. 10/702,547, filed on Nov. 7, 2003.

(30) Foreign Application Priority Data

Nov. 14, 2002 (GB) ..... 0226559

(51) Int. Cl.
*B22C 9/04* (2006.01)

(52) U.S. Cl. ..... 164/361; 164/516

(58) Field of Classification Search ..... 164/516, 164/361, 122.1, 122.2, 165
See application file for complete search history.

(56) References Cited

U.S. PATENT DOCUMENTS 5,234,047 A * 8/1993 Rose ..... 164/358

* cited by examiner

*Primary Examiner*—Len Tran
(74) *Attorney, Agent, or Firm*—W. Warren Taltavull; Manelli Denison & Selter PLLC

(57) ABSTRACT

An investment mould process for forming a cast member is described. The process comprises forming a precursor casting (12) from a master mould (10). The master mould (10) has an internal surface (16) defining a space (14) in which the precursor casting (12) can be formed. The surface (16) defines a location indentation (20) to provide a corresponding location projection (3) on the precursor casting (12). A holding member (22) can be inserted into the location projection (3) to hold an internal member (17A, 17B).

9 Claims, 4 Drawing Sheets

INVESTMENT MOULDING PROCESS AND APPARATUS

This is a divisional national application No. 10/702,547 filed Nov. 7, 2003.

This invention relates to investment moulding process and apparatus. Particularly, but not exclusively, the invention relates to investment moulding methods and apparatus for manufacturing aerofoil blades, for example turbine blades.

In the gas turbine industry, turbine blades need to be manufactured with cooling passages for the flow of cooling air therethrough. Generally, turbine blades are manufactured by an investment moulding process in which the blades are formed from a single crystal of the material.

The investment moulding process involves the use of a master mould to provide a wax precursor of the turbine blade. The wax precursor is covered with a ceramic material by being dipped in a slurry of the ceramic material which sets to form an investment mould. The investment mould is then heated to melt the wax which flows away. Finally, the molten metallic alloy material to form the turbine blade is poured into the ceramic investment mould, and the alloy material allowed to cool and solidify. The ceramic material is then dissolved using a suitable acid.

In order to form the passages in the blade, the master mould is initially provided with a ceramic core which corresponds to the shape of the cooling passage, around which the wax is poured. In order to ensure that the ceramic core is held in place when the wax is melted away, pins formed of a platinum material (called p-pins) are inserted through the wax precursor so that their ends engage the core. Generally, the pins are inserted in pairs opposite to each other to ensure that the core is held securely in place.

In order to ensure that the pins are located securely, the pins project from the wax, and a pyramidal wax formation is provided on the precursor around each p-pin.

According to one aspect of this invention, there is provided a master mould for forming a precursor casting of a cast member in an investment moulding process, the master mould having an internal surface defining a space in which precursor casting can be formed, and the surface further defining a location indentation to provide a location projection on the precursor casting into which a holding member can be inserted to hold an internal member in the precursor casting.

The preferred embodiment is particularly suitable for use in investment moulding processes for forming cast members having a channel or passage therethrough. An example of such a cast member is an aerofoil member such as a turbine or compressor blade of a gas turbine engine, where the channel is a conduit for the passage of gas therethrough, for example for cooling the aerofoil member. In such embodiments, the air channel can be provided in the aerofoil member by the use of a core member in the investment casting process.

The precursor casting may be formed of a suitable first removable material for example a meltable material such as wax. The internal member may be formed of a suitable second removable material, which may be dissolvable, such as a ceramic material.

Preferably, the location indentation has a first dimension transverse to said surface, and has a second dimension generally parallel to said surface, the first dimension being less than the second dimension. This has the advantage in the preferred embodiment of spreading out strain in the material forming the cast member, thereby reducing the tendency of said material to re-crystallise in the region of the location projection during the final stage of the investment casting process.

Desirably, the first dimension is in the range of 0.2 mm to 5 mm, and preferably, in the range of 0.3 mm to 1 mm. More preferably the first dimension is substantially 0.4 mm.

Desirably, the second dimension is in the range of 1 mm to 30 mm, and preferably, in the range of 2 mm to 10 mm. Most preferably, the second dimension is substantially 3 mm.

In one embodiment, the location indentation is generally circular. In another embodiment, the location indentation may have a generally aerodynamic configuration.

Preferably, the master mould defines a plurality of said location indentations, which may be arranged in pairs. The indentations of each respective pair may be arranged generally opposite each other.

According to another aspect of this invention, there is provided a precursor casting of a cast member to be formed during an investment moulding process, the precursor casting having the configuration of the cast member, the precursor casting comprising a main body and an internal member within said main body, the main body having an external surface on which is provided a location projection into which a holding member can be located to hold the internal member in the precursor casting, wherein the location projection has a first dimension transverse to said surface and a second dimension generally parallel to said surface, the first dimension being less than the second dimension.

The precursor casting may be formed of a suitable first removable material, for example a meltable material such as a wax. The internal member may be formed of a suitable second removable material, such as a ceramic material.

Preferably, the location projection has a first dimension transverse to said external surface, and has a second dimension generally parallel to said surface, the first dimension being less than the second dimension.

Desirably, the first dimension is in the range of 0.2 mm to 5 mm, and preferably in the range of 0.3 mm to 1 mm. More preferably, the first dimension is substantially 0.4 mm.

Desirably, the second dimension is in the range of 1 mm to 30 mm, and preferably in the range of 2 mm to 1 mm. More preferably, the second dimension is substantially 3 mm.

In one embodiment, the location projection may be generally circular. In another embodiment, the location projection may be generally of an aerodynamic configuration.

Preferably, the precursor casting includes a plurality of said location projections, which may be arranged in pairs. The projections of each respective pair may be arranged generally opposite each other.

According to a further aspect of this invention, there is provided an investment moulding process for forming a cast member, the investment moulding process comprising providing a master mould, using the master mould to form a precursor casting from a removable material, the master mould having an internal surface defining a space in which said precursor casting can be formed, and said surface further defining a location indentation to provide a corresponding location projection on the precursor casting, into which a holding member can be inserted to hold an internal member.

Preferably, the location indentation has a first dimension transverse to said surface, and has a second dimension generally parallel to said surface, the first dimension being less than the second dimension.

Desirably, the first dimension is in the range of 0.2 mm to 5 mm, and preferably in the range of 0.3 mm to 1 mm. More preferably, the first dimension is substantially 0.4 mm.

Desirably, the second dimension is in the range of 1 mm to 30 mm, and preferably in the range of 2 mm to 10 mm. More preferably, the second dimension is substantially 3 mm.

Preferably, the location projection has a first dimension transverse to said surface and a second dimension generally parallel to said surface, the first dimension being less than the first dimension.

Desirably, the first dimension is in the range of 0.2 mm to 5 mm, and preferably in the range of 0.3 mm to 1 mm. More preferably, the first dimension is substantially 0.4 mm.

Desirably, the second dimension is in the range of 1 mm to 30 mm, and preferably in the range of 2 mm to 10 mm. More preferably, the second dimension is substantially 3 mm.

The method may further include locating a holding member on the location projection, and thereafter inserting the holding member into the precursor casting to engage the internal member. Preferably, where the precursor casting is provided with a plurality of location projections, the method includes locating a respective holding member on each location projection and inserting each holding member into the precursor casting to engage the internal member.

Preferably, the method includes encasing the precursor casting in a second removable material to form an investment mould. The method may further include arranging the holding members such that they project outwardly from the precursor casting and are held in place by the further removable material.

The first removable material forming the precursor casting may be removed, for example by heating. Thereafter, a moulding material may be introduced into the investment mould, and allowed to cool. After said cooling, the investment mould may be removed. The investment mould may be formed of a ceramic material which may be removed by dissolving in a suitable leachant, for example an alkali, such as a solution comprising potassium hydroxide or sodium hydroxide.

An embodiment of the invention will now be described by way of example only, with reference to the accompanying drawings, in which.

Figure 1A:
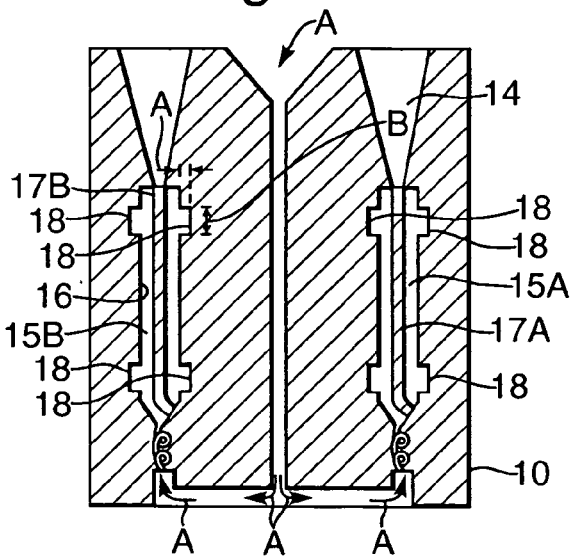
FIGS. 1A to 1H show schematically in cross section an investment moulding process.
Figure 1B:
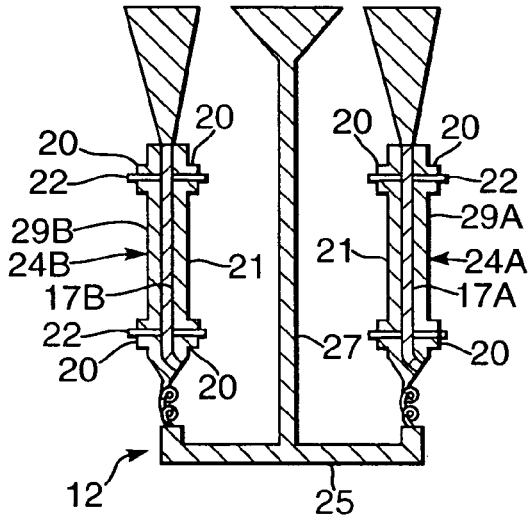

Referring to FIGS. 1A to 1H of the drawings, there is shown an investment moulding process, for use in the formation of turbine blades of a gas turbine engine. The moulding process involves several steps, the first step, as shown in FIG. 1A, being the provision of a master mould 10 formed of a suitable steel material for forming a precursor casting 12 (see FIG. 1B). The master mould 10 has an internal surface 16 which defines an internal three dimensional moulding space 14. In the embodiment shown, the space 14 defines two three dimensional patterns 15A, 15B for the production of two turbine blades, and which correspond to the shape of the blades. The surface 16 in each of the patterns 15A, 15B defines a plurality of location indentations 18 which form on the precursor casting 12 a plurality of location projections 20. The purpose of the location projections 20 is described below.

Each location indentation 18 has a first dimension A, e.g. its depth, generally perpendicular to the internal surface 16 of the patterns 15A, 15B and a second dimension B, e.g. its diameter, generally parallel to the surface 16. In the embodiment shown, the first dimension A is substantially 0.4 mm and the second dimension B is substantially 3 mm.

Each of the patterns 15A, 15B is provided with an internal member in the form of a ceramic core 17A, 17B, which provides in the final turbine blade a channel for the flow of cooling air.

Figure 2:
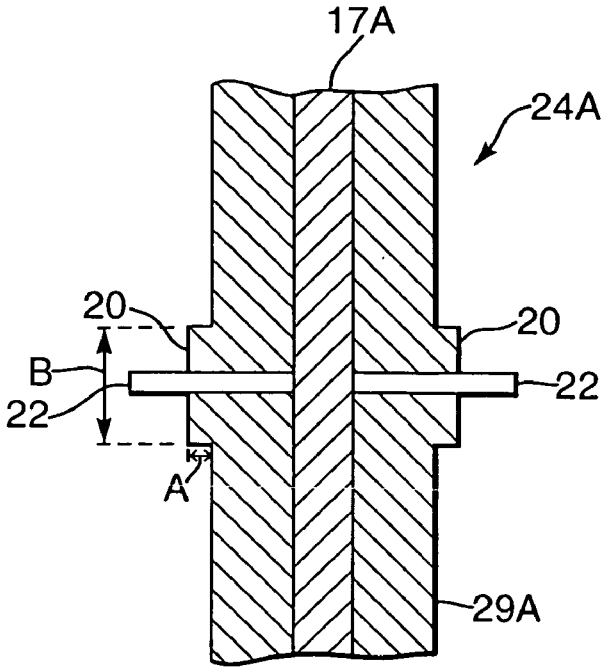
FIG. 2 is a close-up view of part of a precursor casting.

A molten wax material is poured into the master mould 10 to fill it, as shown by the arrows A, and allowed to set therein. After the wax material has set, the wax precursor casting 12 is removed from the master mould 10, and as shown in FIG. 2 includes two wax precursor members 24A, 24B, each of which includes a portion which is the exact shape and size of the turbine blade to be formed. The precursor members 24A, 24B extend from a cross member 25 attached to an upstanding central shaft 27, the purpose of which is described below.

Each precursor member 24A, 24B comprises a main body 29A or 29B and one of the ceramic cores 17A, 17B. Each main body 29A or 29B includes a plurality of the location projections 20 on the outer surface 21 thereof. A pinning apparatus (not shown) is then provided to insert a plurality of holding members in the form of pins 22 into the wax precursor casting 12.

The pins 22 are formed of a platinum material, and are generally referred to as p-pins. Platinum is selected because it dissolves in the metallic alloy material used to form the turbine blades. Each of the pins 22 is located on the wax precursor casting 12 generally centrally of each respective location projection 20. The pins 22 are inserted through the wax material until each one engages the ceramic core 17A or 17B. As can be seen, the location projections 20 are provided in pairs along the length of each precursor member 24A, 24B.

The pins 22 are of such a length that after they have been inserted, their outer ends extend outwardly from the respective wax precursor member 24A, 24B for a reason that will be explained below.

Figure 1C:
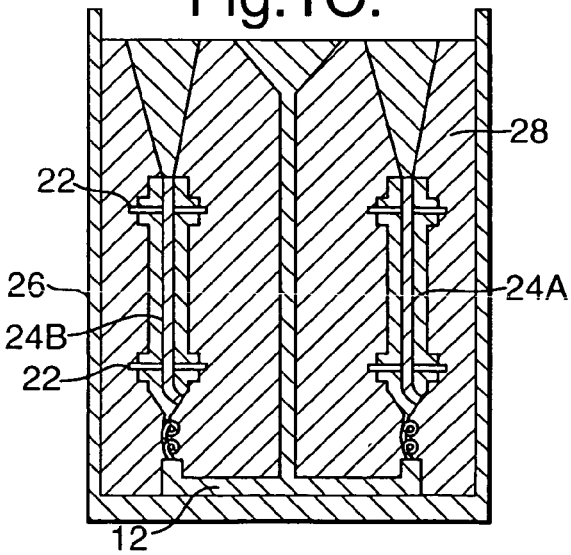

Referring to FIG. 1C after the insertion of the pins 22, the precursor casting 12 is arranged in a vessel 26 and an investment mould 28 is then formed around the wax precursor casting 12. The investment mould 28 is formed of a ceramic material, and a slurry of the ceramic material is poured into the vessel 26 and allowed to set around the wax precursor casting 12. The ceramic material poured into the vessel 26 is similar material to the material from which the ceramic cores 17A, 17B are formed.

Figure 1D:
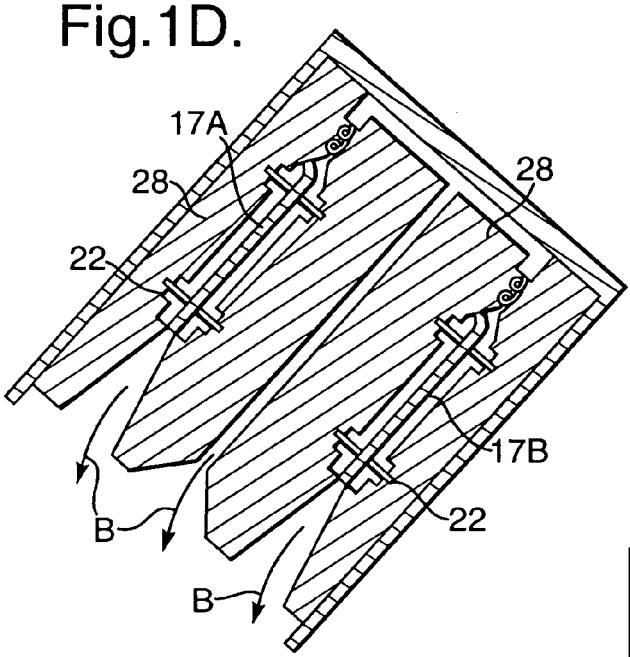

When the ceramic material has set, it is heated and the wax then melts and, as shown by the arrows B in FIG. 1D is poured out of the ceramic investment mould 28. After all the wax has been removed, the investment mould 28 defines investment moulding spaces 36A, 36B in place of the precursor members 24A, 24B. The location projections 20 in the wax precursor casting 12 provide corresponding second indentations 30 in the investment mould 28. The corresponding indentations 30 are of the same shape and size as the location projections 20. The ceramic material is formed around the end regions of the pins 22 to hold the pins 22 in place, thereby holding the ceramic cores 17A, 17B in their respective positions.

The part of the precursor casting 12 which formed the cross member 25 and the central shaft 27 now provides respectively a gallery 32 and a down conduit 34 for the flow of a metallic alloy material therethrough.

Figure 1E:
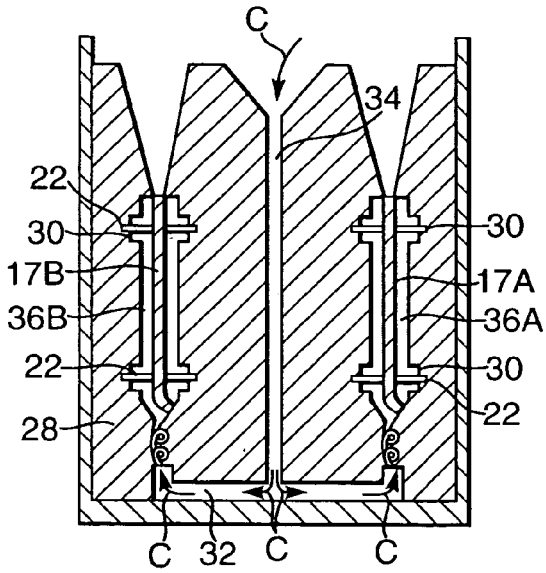

Referring to FIG. 1E, as shown by the arrows C, molten metallic alloy material to form the turbine blades is then poured into the ceramic investment mould 28. Generally this is carried out by pouring the material into the down conduit 34, which is then distributed to the investment moulding spaces 36A, 36B by the gallery 32.

The molten metallic alloy material fills each one of the investment moulding spaces 36A, 36B, around each central ceramic core 17A, 17B. The molten material dissolves away each pin 22 and fills the spaces defined by the second indentations 30 and the outer ends of the pins 22, to form recrystallisation inhibiting projections 37 which correspond in shape, size and position to the and the outer ends of the pins 22.

Figure 1F:
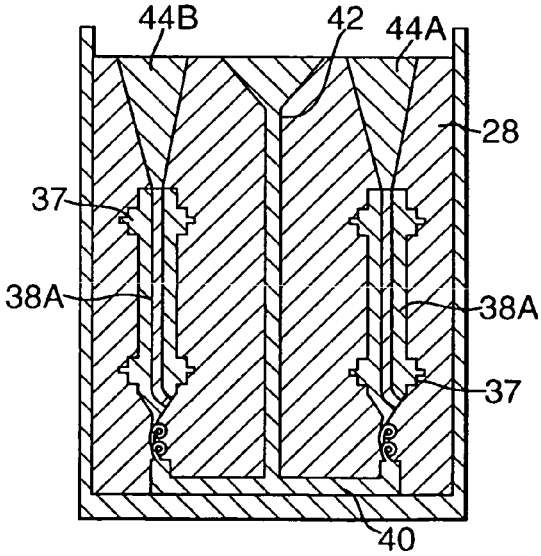

Referring to FIG. 1F, the metallic alloy material is then allowed to crystallise and does so to form a single crystal. The shape of the projections 37 on the final product, provided by the recrystallisation inhibiting indentations 30 in the investment mould 28 are of such shape that they inhibit recrystallisation of the material in that region, i.e. the alloy material forms only a single crystal as it solidifies.

Figure 1G:
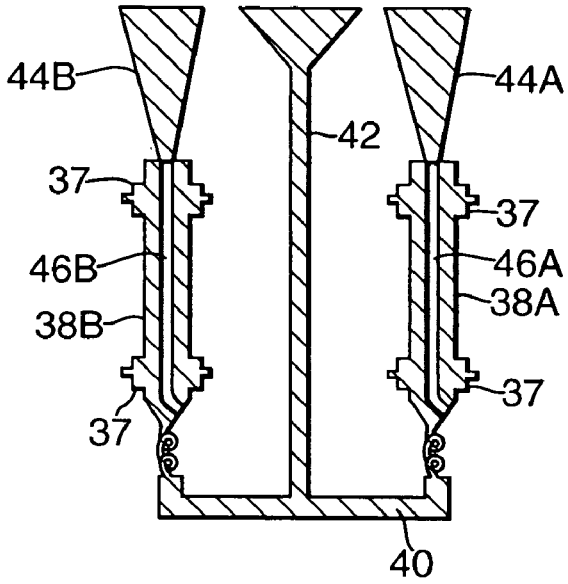
Figure 1H:
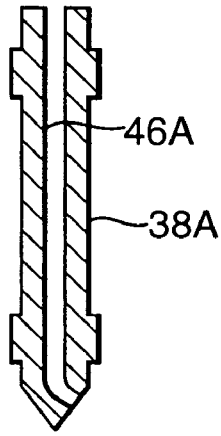

Referring to FIG. 1G, after the material has been allowed to cool and crystallise, the ceramic investment mould 28 is then removed, for example by dissolving it in a suitable leachant, such as an alkali. Two turbine blades 38A, 38B are thus formed, which are mounted on a cross-member 40, from which an upstanding member 42 extends. The cross-member 40 and the upstanding member 42 are formed by the molten material which filled the gallery and the drawn conduit 34. Also on top of each blade 38A, 38B, there is a further member 44A, 44B. The blades 38A, 38B are removed from the cross-member 40 and the further members 44A, 44B are also removed. The blades 38A, 38B can then be finished to removed unwanted material to provide the final finished blade, one of which 38A is shown in FIG. 1H The leachant also dissolves the central cores 17A, 17B leaving in each blade 38A, 38B a conduit 46A, 46B for the passage of cooling air therethrough when the blade is in use.

Referring to FIG. 2, there is shown a cross-sectional side view of part of the wax precursor member 24A in the region of the location projections 20. As discussed above, the pins 22 are located on the respective location projection 20 and inserted into the main body 29A until one end of the pin 27 engages the ceramic core 17A. The outer end region of each pin 22 protrudes outwardly from the respective location projection 20 and will be held in place by the set ceramic material when the investment mould 28 is formed.

Each location projection 20 has a first dimension A generally perpendicular to the surface 21 of the precursor casting 12 and a second dimension B generally parallel to the surface 21 of the precursor casting 12. The dimensions A and B are the same as they dimensions A and B of the location indentations 18.

Figure 3:
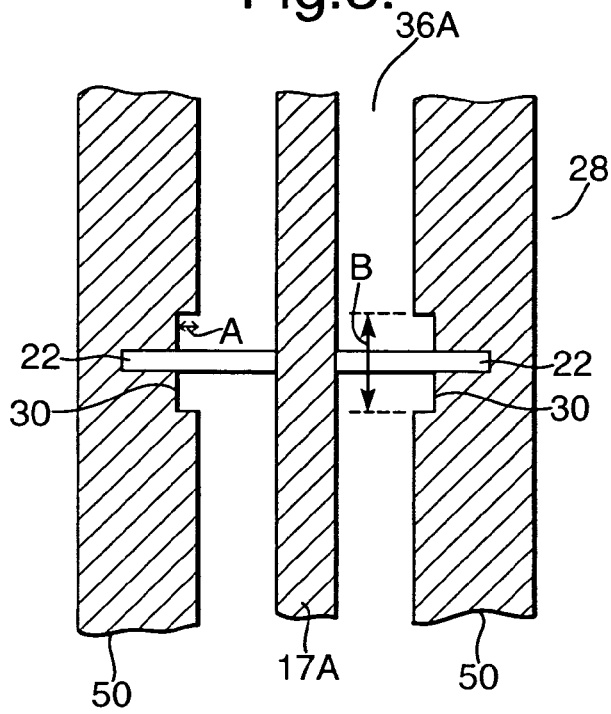
FIG. 3 is a close-up diagrammatic cross-sectional view of part of an investment mould.

FIG. 3 shows part of the investment mould 28 in the region formed by the part of the wax precursor member 24A shown in FIG. 2. The investment mould 28 comprises a main portion 50 which surrounds the moulding space 36A (and the moulding space 36B as well as the gallery 32 and the down conduit 34, but these are not shown in FIG. 3). The pins 22, which are located at the second indentations 30, hold the ceramic core 17A in place, and the pins 22 are in turn held in place by the ceramic material of the main portion 50. The second indentations 30 have first and second dimensions which are the same as the first and second dimensions A and B of the location indentations 18 and the location projection 20.

Figure 4:
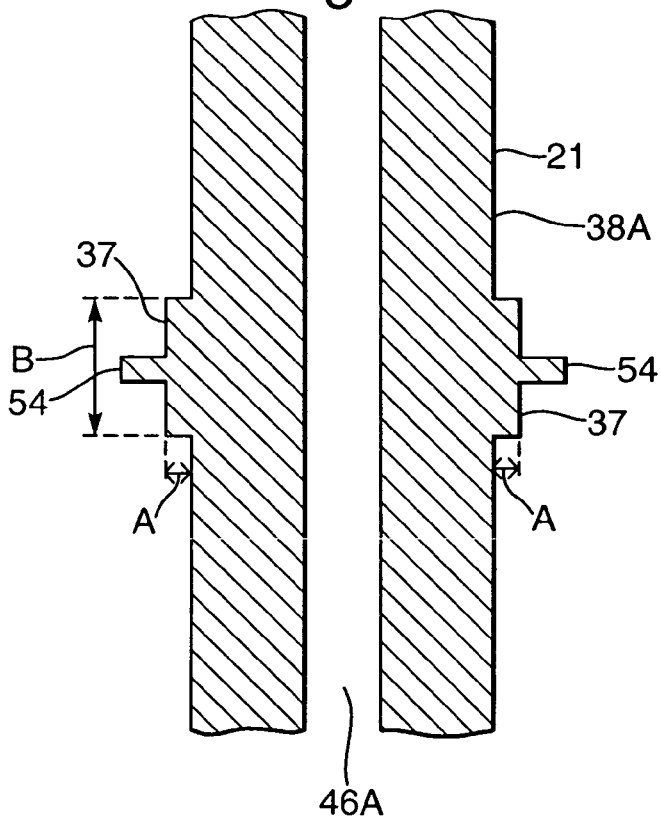
FIG. 4 is a close-up diagrammatic view of part of a final product.

Referring to FIG. 4, there is shown a cross-sectional side view of part of one of the turbine blades 38A in the region formed by the part of the investment mould shown in FIG. 3. The blade 38*a* is shown prior to finishing to remove unwanted material. As can be seen the recrystallisation inhibiting projections 37 in the form of a disc shaped member which corresponds to the second indentation 30 in the investment mould 28. An elongate extension 54 extends from the projection 37 and 54 which corresponds to the outer end region of the pin, 22 which has been dissolved by the molten alloy material.

Before the blade 38 can be used, it will be desirable to remove either just the elongate extension 54, or the recrystallisation inhibiting projection 37 in addition to the elongate extension 54. This can be done by any suitable means know in the art.

The dimensions are also possessed by the location projection 20 in the wax precursor 12, by the recrystallisation inhibiting indentations 30 in the investment mould 28 and by the recrystallisation projections 37 in the blades 37A, 38A.

The main part 52 of the projection 37 has been described above as being a disc shaped member. It will be appreciated, however, that the main part 52 of the projections 37 could be any other suitable shape and, on one embodiment, the projection can be of an aerodynamic shape which may assist with the passage of air across the surface of the blade.

There is thus described an apparatus for forming turbine blades of a gas turbine engine in the preferred embodiment, and which obviates the prior art problems associated with having to form pyramidal formations on the wax precursor casting after it has been formed. There is also described a method for producing such turbine blades which is generally more efficient and more economical than prior art methods.

Various modifications can be made without departing from the scope of the invention. For example, in the above description, we have referred to the final product as being a turbine blade. It will be appreciated that, however, the invention can be used to form other articles in which it is necessary to provide a central passage, and which are generally formed by investment casting. An example of such a product is a compressor blade for a gas turbine engine. Also, the above description relates only to the formation of two turbine blades, but it will be appreciated that any desired number of turbine blades, or compressor blades or any other suitable article can be formed using the above desired process.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A precursor casting of a cast turbrine to be formed during an investment moulding process, the precursor casting having the configuration of the cast turbrine the precursor casting comprising a main body and an internal member within said main body, the main body having an external surface characterised in that a location projection for cooling is provided on the external surface into which a holding member is located to engage the internal member in the precursor casting, wherein the location projection has a first dimension transverse to said surface and a second dimension generally longitudinal of said surface, the first dimension being less than the second dimension.

2. A precursor casting of a cast turbrine to be formed during an investment moulding process, the precursor casting having the configuration of the cast turbrine the precursor casting comprising a main body and an internal member within said main body, the main body having an external surface characterised in that a location projection for cooling is provided on the external surface into which a holding member is located to engage the internal member in the precursor casting, wherein the location projection has a first dimension transverse to said surface and a second dimension generally longitudinal of said surface, the first dimension being less than the second dimension wherein the ratio of the first dimension to the second dimension is in the range of 1:5 to 1:10.

3. A precursor casting according to claim 2 characterised in that the ratio of the first dimension to the second dimension is in the range of 1:6 to 1:10.

4. A precursor casting according to claim 3 characterised in that the ratio of the first dimension to the second dimension is in substantially 1:7.5.

5. A precursor casting according to claim 1 characterised by being formed of a suitable first removable material.

6. A precursor casting according to claim 1 characterised in that the internal member is formed of a second removable material.

7. A precursor casting according to claim 1 characterised in that the location projection is generally circular.

8. A precursor casting according to claim 1 characterised in that the location projection is generally of an aerodynamic configuration.

9. A precursor casting according to claim 1 characterised in that the precursor casting includes a plurality of said location projections arranged in pairs, generally opposite each other.

* * * * *